United States Patent [19]

Toth

[11] Patent Number: 4,982,837

[45] Date of Patent: Jan. 8, 1991

[54] KEY CADDY DEVICE

[76] Inventor: Hedvig Toth, 701 Royal Palm Place, Vero Beach, Fla. 32960

[21] Appl. No.: 512,187

[22] Filed: Apr. 20, 1990

[51] Int. Cl.[5] ..... A45C 11/18; A45C 11/32

[52] U.S. Cl. ..... 206/38.1; 206/39.7

[58] Field of Search ..... 206/38.1, 37.1, 37.8, 206/39.7

[56] References Cited

U.S. PATENT DOCUMENTS 2,467,985 4/1949 Patts ..... 206/38.1

4,907,694 3/1990 Miller et al. ..... 206/38.1 X

FOREIGN PATENT DOCUMENTS 1398957 4/1965 France .

*Primary Examiner*—William I. Price

*Attorney, Agent, or Firm*—Carroll F. Palmer

[57] ABSTRACT

An improved key caddy device includes a rectangular strip of flexible sheet material that forms a case by overlapping the transverse edges and fastening them together with a first fastener assembly, e.g., a two-part snap button fastener, fixed to the strip. A key ring is carried, advantageously in a grommet, on the strip adjacent one of its longitudinal edges to receive one or more keys. A folded sheet bearing text, e.g., a printed road map, is enclosed within the flexible case and held therein by a second fastener assembly, e.g., two pieces of Velcro®. A user of the caddy device accesses the road map or like folded sheet by opening the case and disconnecting the second fastener assembly to free the text containing sheet from the case.

6 Claims, 1 Drawing Sheet

KEY CADDY DEVICE

BACKGROUND OF THE INVENTION

1. Field of the Invention

This application relates to key caddy devices. More particularly, it concerns such devices comprising a combination of a key ring with a pocket-size case housing a folded road map or other folded sheet bearing text in a manner allowing the user of the device to conveniently access the text when the need to do so may occur.

2. Description of the Prior Art

Key rings designed to store one or more keys frequently have attached thereto a fob, a tag, an ornament or similar item for identification, or other purpose. The present invention utilizes such known concept of attaching items in addition to keys to key rings in a unique way to provide new key caddy devices to provide key users a source of information, instruction or the like related to the utilization of a key attached to the device.

OBJECTS

A principal object of the invention is the provision of unique key caddy devices.

A further object is the provision of such devices that permit key users to immediately access a source of information, instruction or the like related to the utilization of a key attached to the device without subjecting the key user to any annoyance in having immediate access to such source.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of an improved key caddy device which comprises a substantially rectangular strip of flexible sheet material having an external surface and an internal surface, such strip being defined by first and second parallel longitudinal edges and first and second transverse edges of shorter length than the longitudinal edges. The flexible strip forms a case by overlapping the first and second transverse edges.

A first fastener assembly which serves to hold the overlapped edges together comprises a first fastener element and a second fastener element. The first fastener element is fixed to the strip adjacent one of the transverse edges and the second fastener element is fixed to the strip adjacent the other of the transverse edges so that such elements may be connected to form the case. Typically the first fastener assembly is a snap button type fastener.

The caddy device includes a second fastener assembly comprising a third fastener element and a fourth fastener element. The third fastener element is fixed to the internal surface of the strip. Typically, the second fastener assembly consists of a pair of segments of hook and loop type fabric, e.g., Velcro ®.

A folded sheet bearing text, e.g., a printed road map, to which the third fastener element is fixed is enclosed within the flexible case whereby the folded sheet may be accessed by a user of the caddy device by opening the case and disconnecting the third and fourth fastener elements to free the sheet from the strip.

Completing the new combination of elements forming the improved key caddy devices, a key ring is carried, advantageously in a grommet, on the strip adjacent one of the longitudinal edges thereof.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
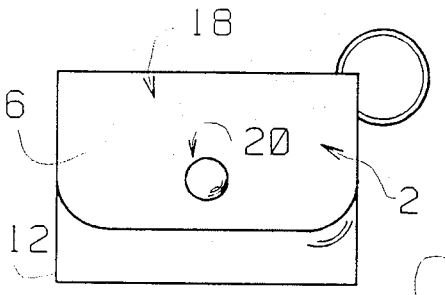
FIG. 1 is a plan view of one embodiment of a key caddy device of the invention in its normal storage and use configuration.
Figure 2:
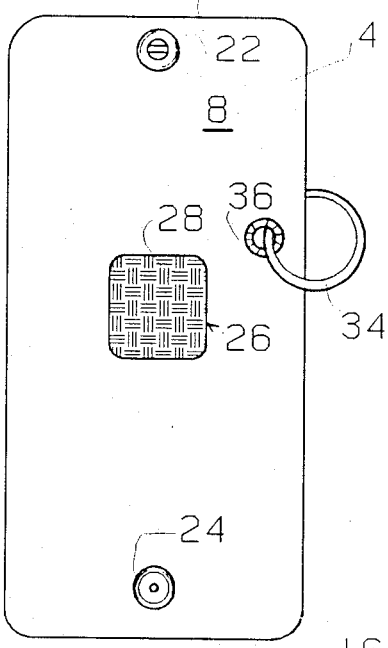
FIG. 2 is a internal, plan view of the device of FIG. 1 in its unfolded configuration with its text component removed.
Figure 3:
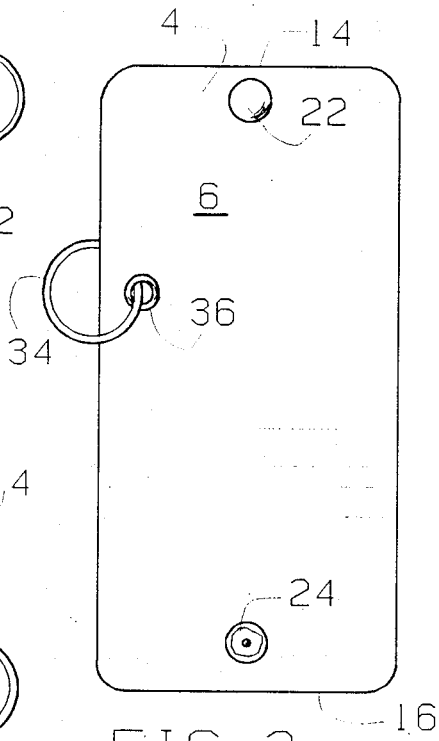
FIG. 3 is a external, plan view of the device of FIG. 1 in its unfolded configuration.
Figure 4:
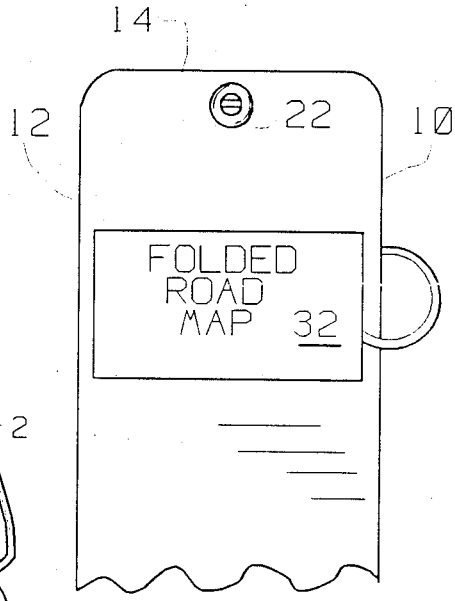
FIG. 4 is a fragmentary, internal, plan view of the device of FIG. 1 in its unfolded configuration with its text component in position.

The improved key caddy device 2 of the invention comprises a substantially rectangular strip 4 of flexible sheet material having an external surface 6 and an internal surface 8, such strip being defined by first and second parallel longitudinal edges 10 and 12 and first and second transverse edges 14 and 16. Strip 4 is typically made of leather, plastic or woven fabric. Text, designs or like markings or ornamentation may be printed, engrossed, etc. on one or both of surfaces 6 and/or 8.

A first fastener assembly 20 which serves to hold the overlapped edges together comprises a first fastener element 22 and a second fastener element 24. The element 20 is fixed to the strip 4 adjacent transverse edge 14 and element 24 is fixed to the strip adjacent the transverse edge 16 so that such elements may be connected to form the case 18. Typically, the first fastener assembly is a snap button type fastener as shown, but may be of other type, e.g., Velcro ® segments, hook and eye, or equivalent.

Figure 5:
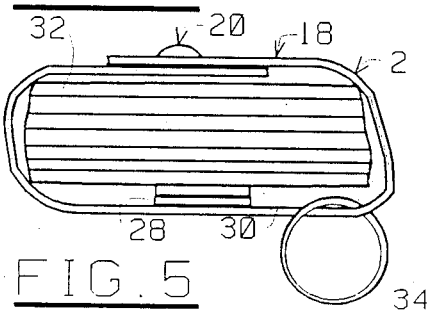
FIG. 5 is a lateral view of the key caddy device of the invention in its normal storage and use configuration.

The flexible strip forms a case 18 by overlapping the edges 14 and 16 and joining element 22 to element 24 as shown in FIG. 5.

The caddy device 2 includes a second fastener assembly 26 comprising a third fastener element 28 and a fourth fastener element 30. Element 28 is fixed to the internal surface 8 of strip 4. Typically, the second fastener assembly consists of a pair of segments of hook and loop type fabric, i.e., Velcro ®, but it may be of other type, e.g., snap button, hook and eye, etc.

A folded sheet 32 bearing text, e.g., a printed road map, to which the fastener element 30 is fixed is enclosed within the flexible case 18 whereby the folded sheet 32 may be accessed by a user of the caddy device 2 by opening the case 18 and disconnecting the sheet 32 from the strip 4.

Finally, a key ring 34 is carried, advantageously in a grommet 36, on the strip 4 adjacent one of the longitudinal edges thereof.

The embodiments of the invention in which an exclusive property or privilege is claimed are defined as follows:

1. An improved key caddy device which comprises:

a substantially rectangular flexible strip of sheet material having an external surface and an internal surface, said strip being defined by first and second parallel longitudinal edges and first and second transverse edges of shorter length than said longitudinal edges, a first fastener assembly comprising a first fastener element and a second fastener element, said first fastener element being fixed to said strip adjacent one of said transverse edges and said second fastener element being fixed to said strip adjacent the other of said transverse edges so that when said first and second elements are connected, said flexible strip forms a flexible case in which said first and second transverse edges overlap each other, a second fastener assembly comprising a third fastener element and a fourth fastener element, said third fastener element being fixed to said internal surface of said strip, a key ring carried on said strip adjacent one of said longitudinal edges thereof, and a folded printed sheet, to which said fourth fastener element is fixed and releasably held thereby to said third fastener element, is enclosed within said flexible case whereby said folded sheet may be accessed by a user of said caddy device by opening said case and disconnecting said third and fourth fastener elements to permit said folded sheet and fourth fastener element to be removed from said caddy device.

2. An improved key caddy device which comprises:

a substantially rectangular flexible strip of sheet material having an external surface and an internal surface, said strip being defined by first and second parallel longitudinal edges and first and second transverse edges of shorter length than said longitudinal edges, a first fastener assembly comprising a first fastener element and a second fastener element, said first fastener element being fixed to said strip adjacent one of said transverse edges and said second fastener element being fixed to said strip adjacent the other of said transverse edges so that when said first and second elements are connected, said flexible strip forms a flexible case in which said first and second transverse edges overlap each other, a second fastener assembly comprising a third fastener element and a fourth fastener element, said third fastener element being fixed to said internal surface of said strip, a key ring carried on said strip adjacent one of said longitudinal edges thereof, and a folded map, to which said fourth fastener element is fixed and releasably held thereby to said third fastener element, is enclosed within said flexible case whereby said map may be accessed by a user of said caddy device by opening said case and disconnecting said third and fourth fastener elements to permit said map to be removed from said caddy device.

3. The key caddy device of claim 2 wherein said map is a road map.

4. The key caddy device of claim 1 wherein said first fastener assembly is a snap button type fastener.

5. The key caddy device of claim 1 wherein said second fastener assembly consists of a pair of segments of hook and loop type fabric.

6. The key caddy device of claim 1 wherein said key ring is carried in a grommet fixed adjacent one of said longitudinal edges of said strip.

* * * * *